US006962157B2

(12) United States Patent
Lee et al.

(10) Patent No.: US 6,962,157 B2
(45) **Date of Patent: *Nov. 8, 2005**

(54) HAIR EXTENSION APPARATUS AND RELATED METHODS

(75) Inventors: John S. Lee, San Marino, CA (US); Su-Jin Lee, San Marino, CA (US)

(73) Assignee: Soho Fashion, Inc, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/976,220

(22) Filed: Oct. 28, 2004

(65) Prior Publication Data

US 2005/0072440 A1 Apr. 7, 2005

Related U.S. Application Data

(63) Continuation-in-part of application No. 10/438,133, filed on May 14, 2003, now Pat. No. 6,883,525.

(51) Int. Cl.[7] ..... A41G 3/00; A41G 5/00

(52) U.S. Cl. ..... 132/53; 132/201

(58) Field of Search ..... 132/53, 201, 54–56, 132/105, 106

(56) References Cited

U.S. PATENT DOCUMENTS

| | | | | | |
|---|---|---|---|---|---|
| 464,559 | A | * | 12/1891 | Emery | 132/105 |
| 739,560 | A | * | 9/1903 | Roehm et al | 132/106 |
| 966,110 | A | * | 8/1910 | Matthaus | 132/53 |
| 1,775,209 | A | * | 9/1930 | Oppenheim | 132/105 |
| 1,780,766 | A | * | 11/1930 | Oppenheim | 132/105 |
| 3,678,942 | A | * | 7/1972 | Abbott et al. | 132/201 |
| 3,955,587 | A | * | 5/1976 | Dunn et al. | 132/53 |
| 4,930,527 | A | * | 6/1990 | Makishima et al. | 132/201 |
| 5,402,805 | A | * | 4/1995 | Barinas | 132/144 |
| 5,657,744 | A | * | 8/1997 | Vianen | 126/299 E |
| 6,035,861 | A | * | 3/2000 | Copello | 132/201 |

FOREIGN PATENT DOCUMENTS

JP 2002348716 A * 12/2002 ..... A41G 3/00

* cited by examiner

*Primary Examiner*—Todd E. Manahan
*Assistant Examiner*—Robyn Doan
(74) *Attorney, Agent, or Firm*—Dan M. De La Rosa

(57) ABSTRACT

A hair extension device is provided wherein the hair extension device comprises: at least one comb; at least one bendable member having opposing ends, a first end being attached to the comb; and at least one length of hair attached to the second end of the bendable member wherein the end user forms a ponytail and the comb is attached onto the end user's existing hair adjacent to the ponytail and the bendable member is bent around the ponytail and shaped to provide for a plurality of hairstyles.

19 Claims, 3 Drawing Sheets

HAIR EXTENSION APPARATUS AND RELATED METHODS

RELATED APPLICATION

This application is a continuation-in-part application of U.S. application Ser. No. 10/438,133, entitled "Hair Extension Device" which was filed on May 14, 2003 now U.S. Pat. No. 6,883,525.

BACKGROUND OF THE INVENTION

1. Field of the Invention

This invention generally relates to hair attachment apparati and related methods of manufacture. More specifically, the present invention provides for a hair extension apparatus comprising: at least one comb; at least one bendable member having opposing ends, a first end being attached to the comb; and at least one length of hair attached to the second end of the bendable member wherein the end user forms a ponytail and the comb is attached onto the end user's existing hair adjacent to the ponytail and the bendable member is bent around the ponytail and shaped to provide for a plurality of hairstyles.

2. Description of the Related Art

Hairpieces and hair extensions are well known in the beauty industry. Hair pieces are commonly used by individuals with thin hair to provide a fuller and, often, a more appealing look. Hair extensions are also often used to provide a fuller looking heads of hair. However, hair extensions are also used cosmetically to allow the user to change their hair style quickly and without having to wait for their natural hair to grow to the required length in order to obtain the desired style.

Known forms of hair extensions include hair attached to clips, combs and elastic bands. These hair extensions may be arranged in and around the natural hair. However, many of these devices require a great deal of skill to properly arrange on the head in an unobtrusive manner. In addition, some devices are hard to keep secured on the head during times of physical exertion such as, for example, during exercise routines, running and dancing the jitterbug. Furthermore, other hair extensions are not diverse in that they are limited in terms of the hairstyles that they provide.

One example of a known hair extension device, often referred to as a scrunchy, attaches hair to an elastic band. The band is then wound around a ponytail formed on the users head from the natural hair. The elastic of the scrunchy acts like a rubber band and secures the user's ponytail. The hair attached to the elastic may then be left to hang loose or gathered to form a bun or a ponytail. The scrunchy device, though, tends to slip during physical activity causing the users hair to become tangled. In addition, the elastic tends to lose its elasticity over time, making the device ineffective for its intended use.

It would be desirable, therefore, to provide a hair extension device that overcomes these and other disadvantages. It would also be desirable to have a hair extension device that would provide for a plurality of different hairstyles.

SUMMARY OF THE INVENTION

In one embodiment, the present invention relates to a hair extension apparatus comprising: at least one comb; at least one bendable member having opposing ends, a first end being attached to the comb; and at least one length of hair attached to the second end of the bendable member wherein the end user forms a ponytail and the comb is attached onto the end user's existing hair adjacent to the ponytail and the bendable member is bent around the ponytail and shaped to provide for a plurality of hairstyles.

In another embodiment, the length of hair is comprised of a plurality of individual strands of hair sewn together to form the length of hair. In still another embodiment, the plurality of individual strands of hair is curled prior to being secured on the bendable member. In yet another embodiment, the length of hair is comprised of a plurality of individual stands of hair with different hair colors.

In still yet another embodiment, the comb is constructed of a material selected from a group consisting of metal, plastic, bone, shell and mixtures thereof. In a further embodiment, the bendable member is constructed of a material selected from a group consisting of formable wire, formable rubber, formable plastic and mixture thereof. In another further embodiment, the formable wire is coated with rubber.

In still another further embodiment, the hair is attached to the bendable member by wrapping the at least one portion of the length of hair around the bendable member. In yet another further embodiment, the comb is secured to the bendable member by one of the following selected from a group consisting of glue, thread, string, wire and mixtures thereof.

In still yet another further embodiment, the length of hair is selected from a group consisting of real human hair, real animal hair, synthetic hair and mixtures thereof. In another further embodiment, the apparatus comprises a plurality of hair strands, each of the hair strands having different lengths. In another embodiment, the apparatus further comprises a second bendable member with at least one length of hair. In still another embodiment, the apparatus further comprises a plurality of bendable members, each bendable member having at least one length of hair.

In yet another embodiment, the present invention provides for a hair extension device comprising: a comb; at least one elongated bendable member having opposing ends and a central section; and at least one length of hair attached to each of the opposing ends of the bendable member, at least a portion of the central section being attached to the comb, wherein the end user forms a ponytail and the comb is attached onto the end user's existing hair adjacent to the ponytail and the opposing ends of the bendable member with attached hair is bent around the ponytail and shaped to provide for a plurality of hairstyles.

In still yet another embodiment, the present invention relates to a hair extension device comprising: a comb; at least two bendable members having two ends, a first end of each of the bendable members being attached to the comb and a second end of each of the bendable members being attached to at least one length of hair; and a connector situated between the first ends of the first and second bendable members wherein the end user forms a ponytail and the comb is attached onto the end user's existing hair adjacent to the ponytail and the bendable member is bent around the ponytail and shaped to provide for a plurality of hairstyles. In another embodiment, at least a portion of the connector is attached to the comb.

In another further embodiment, the present invention also relates to a hair extension device comprising: a comb; at least one bendable member comprising first and second hair attachment portions and a comb attachment portion disposed between the first and second hair attachment portions; and at least one length of hair attached to the first and second hair attachment portions of the bendable member, a part of the comb attachment portion being attached to the comb, and wherein the first and second hair attachment portions of the bendable member can be bended and shaped by the user to provide for a plurality of hairstyles.

In a further embodiment, the invention provides for a hair extension device comprising a comb, a bendable member attached to the comb and at least one length of hair attached to the bendable member.

In still a further embodiment, the invention further provides a method for manufacturing a hair extension device. The method comprises forming at least one length of hair from a plurality of individual strands of hair; securing an end of a first length of hair to a first end of a bendable member; wrapping the first length of hair around the bendable member a first distance extending from the first end; securing an end of a second length of hair to a second end of the bendable member; wrapping the second length of hair around the bendable member a second distance extending from the second end; and securing a comb to the bendable member between the first length of hair and the second length of hair.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
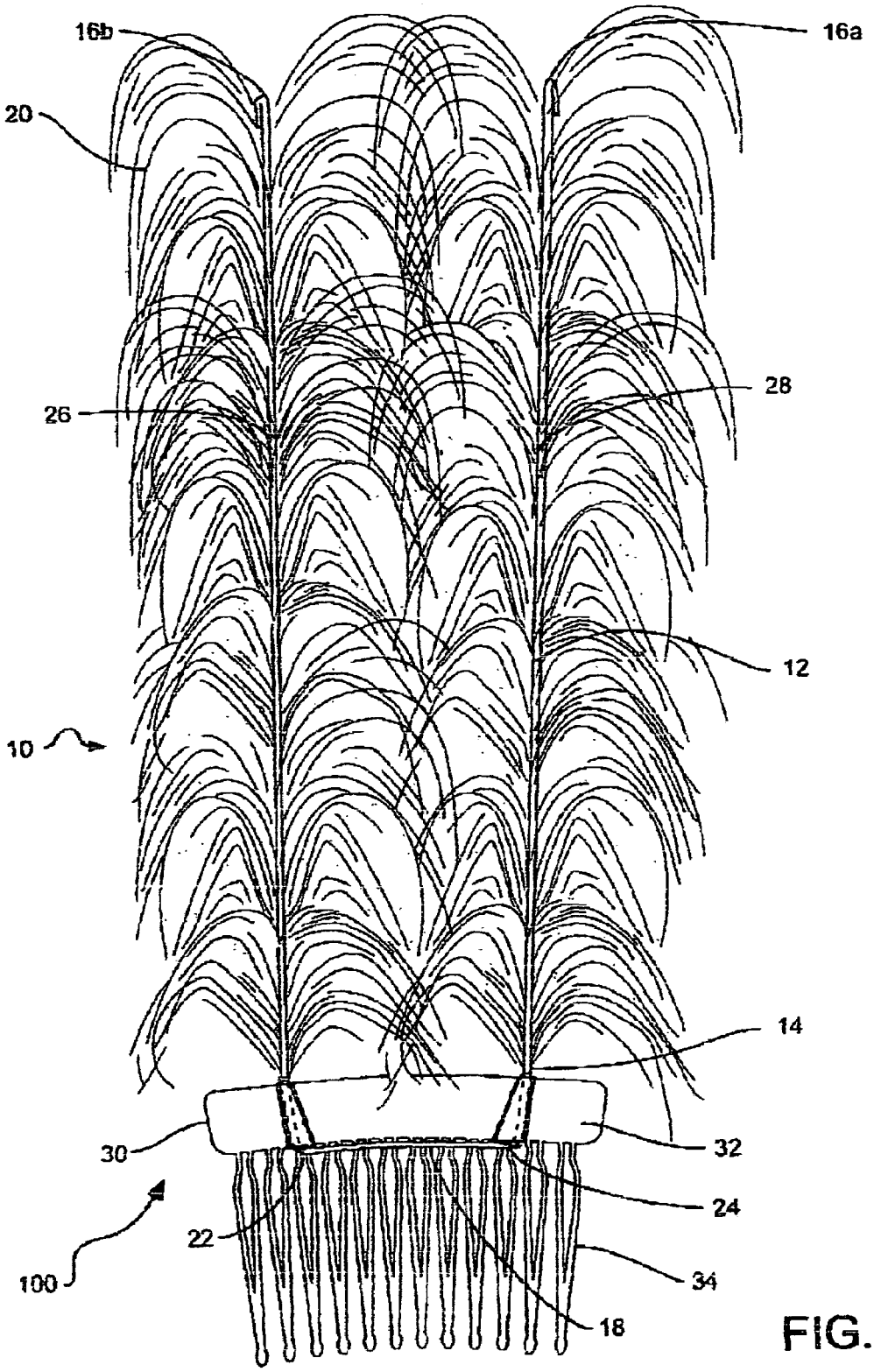
FIG. 1 illustrates one embodiment of a hair extension device in accordance with the invention.
Figure 2:
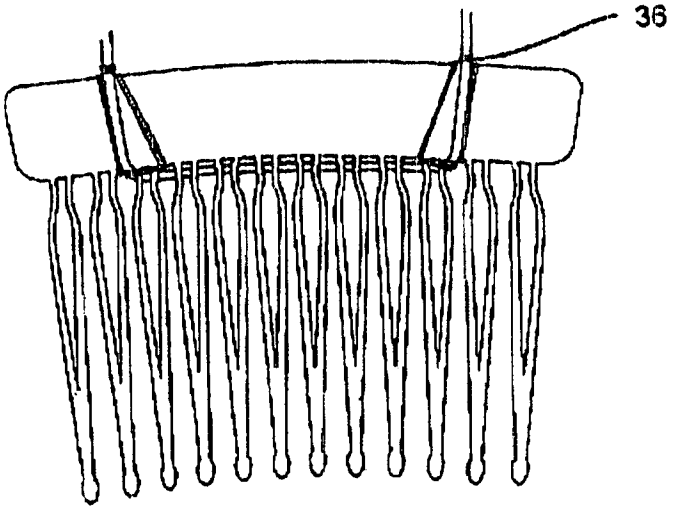
FIG. 2 illustrates a detail of the comb of the hair extension device illustrated in FIG. 1.

Referring now to FIGS. 1 and 2, one embodiment of a hair extension device in accordance with the present is shown generally at 100. Hair extension 100 includes a hair assembly 10 and a comb 30. Hair assembly 10 includes bendable member 12 and hair 20. In one embodiment, hair 20 is synthetic hair. In another embodiment, hair 20 is real hair. Hair 20 may be dyed various colors to approximate natural hair colors or, alternatively, may be dyed bright unnatural colors that are well known in the art. Hair 20 is attached to bendable member 12 by an exemplary method described below.

In the embodiment illustrated in FIG. 1, bendable member 12 is divided into three portions, hair attachment portions 26, 28 and comb attachment portion 18. Comb attachment portion 18 is positioned between hair attachment portions 26 and 28. Hair attachment portions 26, 28 may be of various lengths, the length depending on the style of hair extension desired. In one embodiment, bendable member 12 is a formable metal wire. In another embodiment, bendable member 12 may be, for example, formable plastic. In another embodiment, bendable member 12 may comprise a formable metal wire having a coating. The coating may be, for example, a plastic or a rubber coating.

Figure 4:
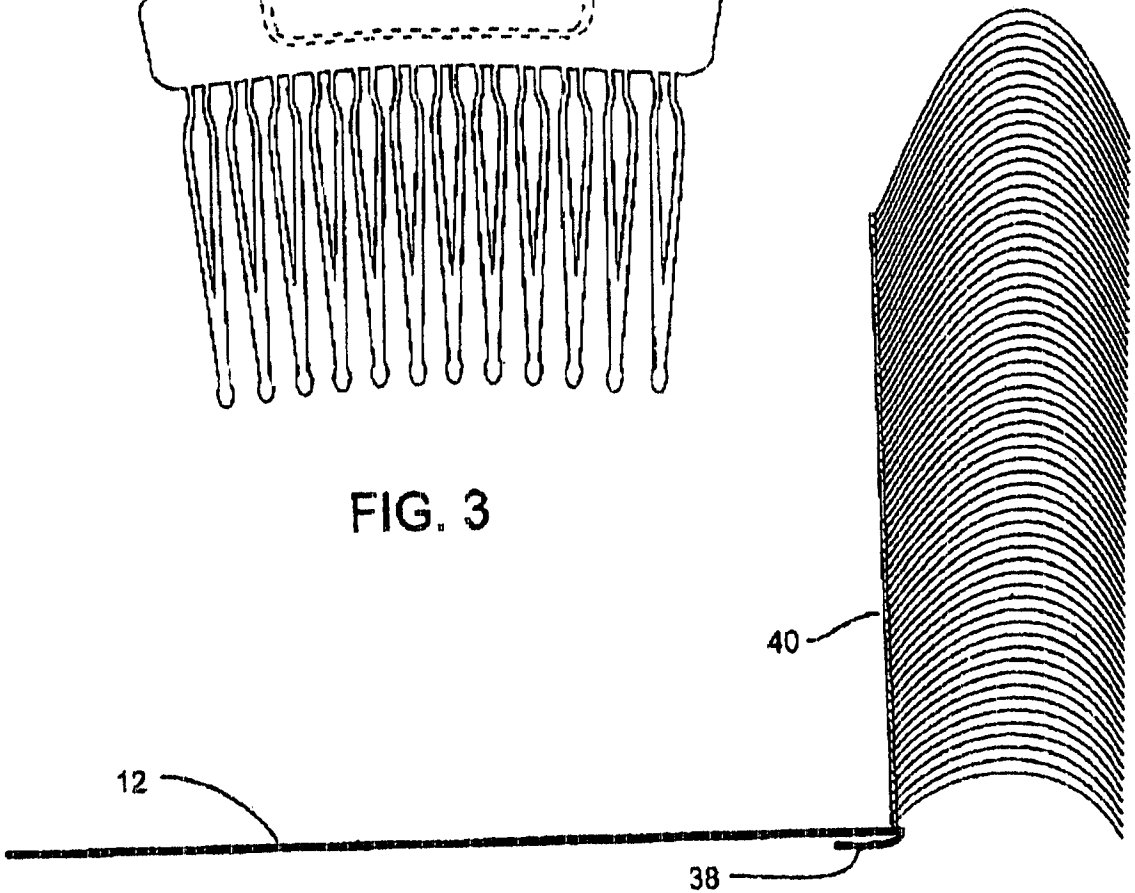
FIG. 4 illustrates a detail of the bendable member and stands of hair of the hair extension device illustrated in FIG. 1.

The embodiment illustrated in FIG. 1 shows a bendable member 12 having an end 16 that is blunt. In one embodiment illustrated in FIG. 4, the blunt end is fashioned in a hook-like manner 38. Those skilled in the art will recognize other configurations to provide a blunt end for bendable member 12. For example, the end may be capped using a small plastic cap that is inconspicuous to the user.

Comb 30 includes body portion 32 and a plurality of teeth 34 extending from the body portion 32 in a manner that is well known in the art. The comb 30 may be formed from plastic, metal, bone, shell or any other suitable material known in the art.

Hair extension device 100 may be fashioned in the following manner. First, strands of hair 20 are sewn together, in a manner that is well known in the art, to form a length of hair 40. In one embodiment, the hair is curled once it is formed into the length of hair. Those skilled in the art will recognize that various types of hair may be used to form the length of hair. For example, the hair may be straight, curly, or wavy. The hair may also be of various lengths depending on the desired style.

Second, one end of the length of hair 40 is securely attached to end 16*a* of bendable member 12. The hair 40 may be secured to end 16*a* by any means known in the art, such as, for example, glue. Once the end of hair 40 is attached, the length of hair is wrapped around the first hair attachment portion 26 of bendable member 12. The length of hair 40 is wrapped around bendable member 12 until it reaches comb attachment portion 18 of bendable member 12. Comb attachment portion 18 of bendable member 12 is not covered by hair 40. This process is repeated for the second hair attachment portion 28 beginning at end 16*b*. Those skilled in the art will recognize that there are other methods known in the art suitable for attaching the hair to device 100.

Once both of the hair attachment portions 26, 28 are covered with hair 40, comb attachment portion 18 of bendable member 12 is bent to form two spaced apart angles 22, 24. Comb 30 is then disposed on comb attachment portion 18 of bendable member 12. The comb 30 may then be secured to the bendable member 12. FIGS. 1 and 2 illustrate that the comb 30 is secured to bendable member 12 using thread 36. Those skilled in the art will recognize that there are other methods of securing the comb 30 to the bendable member 12 such as, for example, by gluing or thin gauge wire.

Figure 3:
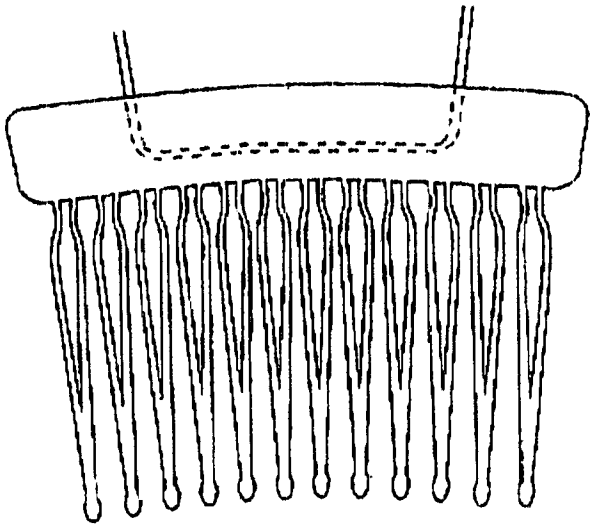
FIG. 3 illustrates another embodiment of the comb of the hair extension device according to the present invention.

Those skilled in the art will recognize that hair extension device 100 may be fashioned in other manners. For example, the comb attachment portion of bendable member 12 may be an integral part of the comb as illustrated in FIG. 3. Other embodiments may attach the bendable member to a barrette-type device instead of a comb.

Figure 5A:
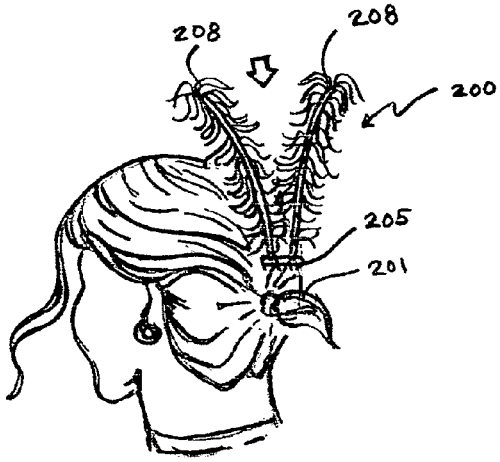
FIG. 5*a–c* shows a user with a ponytail and the hair extension apparatus of the present invention.
Figure 5B:
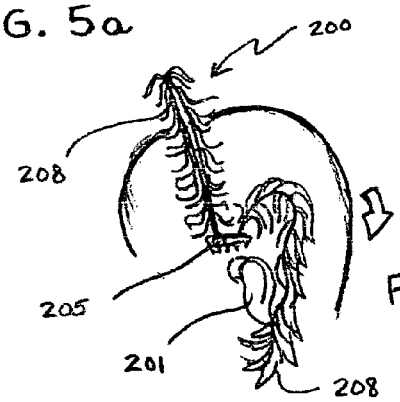
Figure 5C:
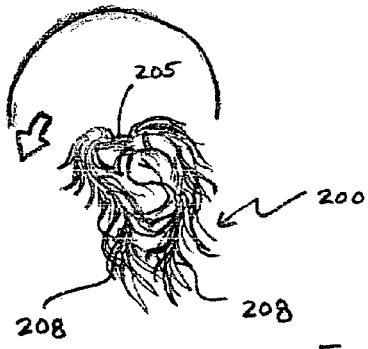

In practice and referring now to FIGS. 5*a–c*, the user of the hair extension device may, first, form their natural hair into a ponytail 201. In FIG. 5*a*, the user then secures the hair extension device 200 on the head by inserting the comb 205 of the hair extension device 200 into the hair adjacent to the ponytail 201. Once secured and as shown in FIG. 5*b*, the user then bends and forms one of the two bendable members 208 of the hair extension device 200 in and around the ponytail 201. In FIG. 5*c*, the second bendable member 208 of the hair extension device 200 is then bent and formed in and around the ponytail 201. Finally, the bendable members 208 and the hair 210 of the hair extension device 200 may then be styled and shaped according to the desired hairstyle of the user.

In another embodiment, the present invention may use another hair attaching means instead of a comb such as a clips, hooks, snap-on elements, barrettes, pins, etc. In such an embodiment, at least a portion of the bendable member will then be attached and secured to the hair attaching means. In another embodiment, the bendable member will have two opposing ends and a central section, and the hair is attached to the opposing ends of the bendable member and at least a portion of the central section is attached to the hair attaching means. In still another embodiment, the hair extension device comprises two ends and a connector, whereby the hair is attached to the two ends and a portion of the two ends are attached to the connector and at least a portion of the connector is attached to the hair attaching means.

Therefore, while the embodiments of the present invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A hair extension device comprising:

a comb having a plurality of teeth and having opposing sides, said teeth of said comb having spaces therebetween;

at least one elongated bendable member having opposing ends and a central section, at least two segments of said member being inserted through at least two separate said spaces thereby allowing said central section of said member to be situated on one side of said comb and said opposing ends of said member to extend outwardly from said opposing side of said comb, said central section being free of any hair; and at least one length of hair attached to each of said opposing ends of said bendable member, at least a portion of said member being attached to said comb, wherein the end user forms a ponytail and said comb is attached onto the end user's existing hair adjacent to the ponytail and said opposing ends of said bendable member with attached hair is bent around the ponytail and shaped to provide for a plurality of hairstyles.

2. The device of claim 1 wherein said length of hair is comprised of a plurality of individual strands of hair sewn together to form the length of hair.

3. The device of claim 2 wherein said plurality of individual strands of hair is curled prior to being secured on the bendable member.

4. The device of claim 1 wherein said length of hair is comprised of a plurality of individual stands of hair with different hair colors.

5. The device of claim 1 wherein said comb is constructed of a material selected from a group consisting of metal, plastic, bone, shell and mixtures thereof and said bendable member is constructed of a material selected from a group consisting of formable wire, formable rubber, formable plastic and mixture thereof.

6. The device of claim 1 wherein said hair is attached to the bendable member by wrapping the at least one portion of said length of hair around said bendable member.

7. The device of claim 1 wherein said comb is secured to said bendable member by one of the following selected from a group consisting of glue, thread, string, wire and mixtures thereof and said length of hair is selected from a group consisting of real human hair, real animal hair, synthetic hair and mixtures thereof.

8. The device of claim 1 wherein said device comprises a plurality of hair strands, each of said hair strands having different lengths.

9. The device of claim 1 further comprises a second bendable member having opposing ends, a first end being attached to said comb.

10. A hair extension device comprising:

a comb having a plurality of teeth and having opposing sides, said teeth of said comb having spaces therebetween;

at least two bendable members having two ends, a first end of each of said bendable members being attached to said comb and a second end of each of said bendable members being attached to at least one length of hair; and a connector situated between said first ends of said first and second bendable members, said connector being free of any hair, said connector being situated on one side of said comb and said ends of said member extending outwardly from said opposing side of said comb, at least a portion of said members adjacent to said connector being inserted through at least two spaced said apart spaces of said comb wherein the end user forms a ponytail and said comb is attached onto the end user's existing hair adjacent to the ponytail and said bendable member is bent around the ponytail and shaped to provide for a plurality of hairstyles.

11. The device of claim 10 wherein at least a portion of said connector is attached to said comb, said comb is constructed of a material selected from a group consisting of metal, plastic, bone, shell and mixtures thereof and said bendable member is constructed of a material selected from a group consisting of formable wire, formable rubber, formable plastic and mixture thereof.

12. The device of claim 11 wherein said formable wire is coated with rubber.

13. The device of claim 10 wherein said length of hair is comprised of a plurality of individual strands of hair sewn together to form the length of hair.

14. The device of claim 10 wherein said plurality of individual strands of hair is curled prior to being secured on the bendable member.

15. The device of claim 10 wherein said length of hair is comprised of a plurality of individual stands of hair with different hair colors.

16. The device of claim 10 wherein said hair is attached to the bendable member by wrapping the at least one portion of said length of hair around said bendable member.

17. The device of claim 10 wherein said comb is secured to said bendable member by one of the following selected from a group consisting of glue, thread, string, wire and mixtures thereof and said length of hair is selected from a group consisting of real human hair, real animal hair, synthetic hair and mixtures thereof.

18. The device of claim 10 further comprises a second bendable member having opposing ends, a first end being attached to said comb.

19. The device of claim 10 wherein said device comprises a plurality of hair strands, each of said hair strands having different lengths.

* * * * *